US005785194A

United States Patent [19]

Ogden

[11] Patent Number: 5,785,194

[45] Date of Patent: Jul. 28, 1998

[54] CAP FOR A CONTAINER AND OPENING MEANS THEREFOR

[75] Inventor: Brian L. Ogden, Dartford, England

[73] Assignee: Warner-Lambert Company, Morris Plains, N.J.

[21] Appl. No.: 806,898

[22] Filed: Feb. 26, 1997

Related U.S. Application Data

[63] Continuation of Ser. No. 415,142, Mar. 28, 1995, abandoned, which is a continuation of Ser. No. 971,766, Feb. 12, 1993, abandoned.

[30] Foreign Application Priority Data

Jun. 7, 1991 [GB] United Kingdom ..... 91 12259

[51] Int. Cl.[6] ..... B65D 85/84

[52] U.S. Cl. ..... 215/302; 220/284; 215/220

[58] Field of Search ..... 215/220, 215, 215/302; 220/284; 7/138; 206/223, 231

[56] References Cited

U.S. PATENT DOCUMENTS

| | | | |
|---|---|---|---|
| 2,973,880 | 6/1961 | Rowell | 220/284 |
| 3,730,372 | 5/1973 | Komendowski | 215/32 |
| 3,929,152 | 12/1975 | Graham | 220/284 |
| 4,382,512 | 5/1983 | Furminger | 220/284 |
| 4,801,028 | 1/1989 | Puresevic et al. | 215/220 |
| 5,033,501 | 7/1991 | Stehling | 220/284 |

FOREIGN PATENT DOCUMENTS

| | | |
|---|---|---|
| 60675/80 | 7/1980 | Australia . |
| 0181115 | 5/1986 | European Pat. Off. . |
| 0182519 | 5/1986 | European Pat. Off. . |
| 705912 | 11/1930 | France . |
| A2048350 | 3/1971 | France . |
| A2612494 | 3/1987 | France . |
| 1596726 | 7/1990 | France . |
| 2236308 | 4/1991 | United Kingdom . |
| WO 88/05755 | 8/1988 | WIPO . |
| WO 89/02858 | 4/1989 | WIPO . |

*Primary Examiner*—Joseph M. Moy
*Attorney, Agent, or Firm*—Nixon & Vanderhye

[57] ABSTRACT

A cap (1) having a top (2) and a depending skirt (3) which receives the neck of a container at its lower end, wherein the skirt (3) is provided at its outer and upper end portion with a first engaging means (6, 7) for engaging an annular spanner located around the cap (1), and a seating means (8) at the base of the first engaging means (6, 7) on which the annular spanner rests. Preferably the cap is for a medicine container and is circular. In a further embodiment the cap is a two part child resistant cap designed to provide tamper evidence. There is further provided a medical implement adapted to engage over the cap and a kit comprising the cap and an annular spanner.

7 Claims, 5 Drawing Sheets

CAP FOR A CONTAINER AND OPENING MEANS THEREFOR

Figure 1:
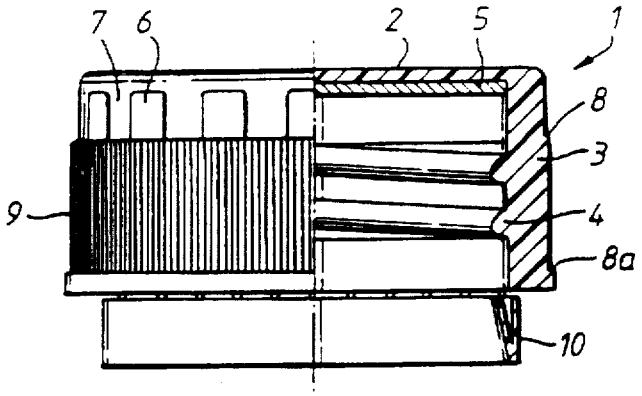

This is a continuation of application Ser. No. 07/971,766, filed 12 Feb., 1993, now abandoned.

This invention relates to a cap for a container particularly for a medical container, and means for opening the cap.

A problem particularly associated with medical containers is that the medicine gums up the screw thread of the container cap thus making it difficult to open, particularly for older arthritic people. In one container cap proposed to mitigate this problem a perpendicular flange is provided on the top of the cap with an aperture through which a pen is received to twist open the cap. Another similar proposal involved a cap having spaced peripheral castellations upstanding from the top of the cap so that a spoon or pen laid across the top and between the castellations could be used to lever open the cap. (Reference to this latter cap is found in the November 1990 edition of Packaging Magazine at pages 24 and 25). The pen or spoon however tends not to grip sufficiently to easily open the cap.

According to a first aspect of the invention there is provided a cap having a top and a depending skirt which receives the neck of a container at its lower end, wherein the skirt is provided at its outer and upper end portion with a first engaging means for engaging an annular spanner located around the cap, and a seating means at the base of the first engaging means on which the annular spanner rests.

In a second aspect of the invention there is provided A medical implement having a multiple purpose comprising an annular spanner having an inner surface with a second engaging means for engaging over a cap for a medical container.

The grip around the circumference of the cap (rather than on the top surface of the cap) by the annular spanner allows easy opening of the container. The annular spanner does not therefore need to be continuous, so long as it grips sufficiently around the cap.

The first and second cooperating engaging means may be screw threads, or if the cap was e.g. hexagonal shape, a hexagonal annular spanner could be used to engage round the circumference of the hexagonal cap. Preferably the first and second engaging means are however one or more cooperating projection and/or recesses.

The annular spanner may form part of a medical implement, such as a spoon or tablet storage box.

The cap and annular spanner (or medical implement) may be sold separately, or as a kit which form the third aspect of the invention.

Accordingly in a third aspect of the invention there is provided a kit comprising a cap having a top and a depending skirt which receives the neck of a container at its lower end, there being first engaging means provided on the outer portion of the skirt; and an annular spanner having an inner surface with second engaging means for engaging with said first engaging means when the annular spanner is located around the cap.

The cap may be formed as a two piece child resistant cap of the type which is simultaneously depressed and twisted such as described in British Patent Nos. 2167050, and 2142612. The cap of this latter patent has an aperture through the top of the outer piece of the cap which is closed by a tamper evident tab. A tamper evident projection is provided on the top of the inner piece of cap and breaks the tamper evident tab when the cap is depressed for opening. The tamper evident tab however catapults off with the force of the depression and can hit the user in the eye. Patent No. 2167050 describes a manually removable tamper evident tab.

Accordingly in a fourth aspect of the invention there is provided a cap of the two part child resistant type cap which is opened by simultaneous depression and rotation and comprises an inner piece having a top with tamper evident projection and a depending annular skirt; an outer piece having a top with an aperture therethrough for receiving the tamper evident projection, a tamper evident tab normally closing the aperture and having connecting pieces, and a depending annular skirt; the top of the inner piece being urged away from the top of the outer piece by resilient means in the closed position; wherein said connecting pieces of the tamper evident tab comprise at least one hinge piece and a breakable piece which will break before the hinge piece when the tamper evident projection is forced against the tab in response to the outer piece being depressed to open the cap.

The tamper evident projection may be formed to interegage with the aperture in the top of the inner piece of the cap, to aid in opening the cap. In the cap of GB2167050, there is provided a hexagonal projection which interengages with a hexagonal aperture.

The invention will now be described by way of example only with reference to the accompanying drawings in which;

FIG. 1. is a partly sectioned side view of a cap container.

Figure 2:
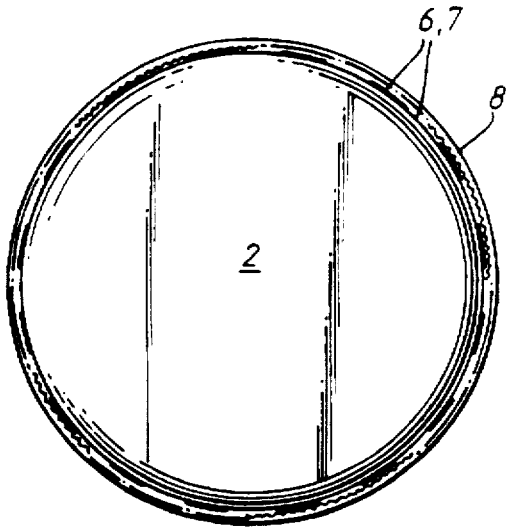

FIG. 2. is a plan view of the cap of FIG. 1.

Figure 3:
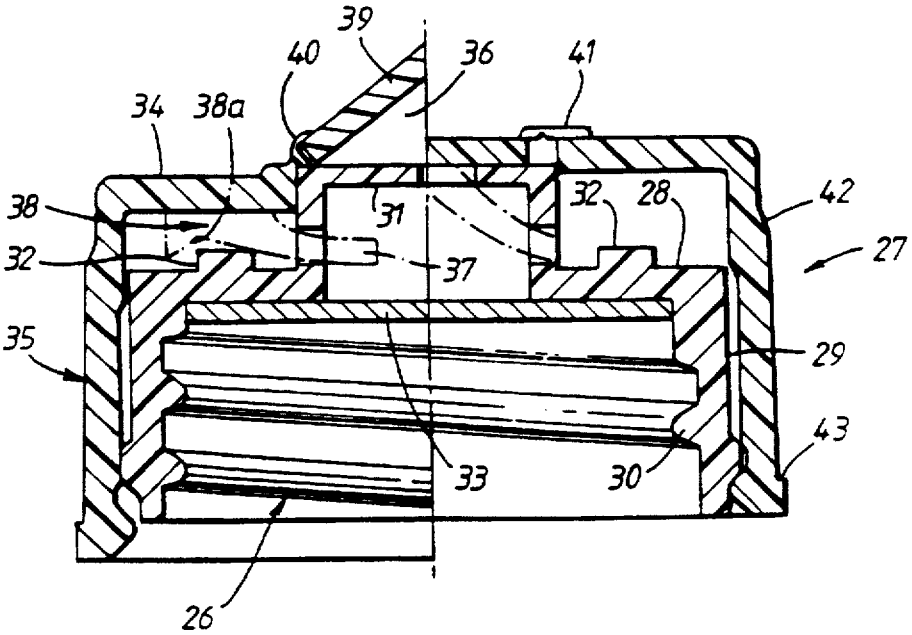

FIG. 3. is a sectioned side view of a second container cap, which shows the cap in a closing position (right hand side) and opening position (left hand side).

Figure 4:
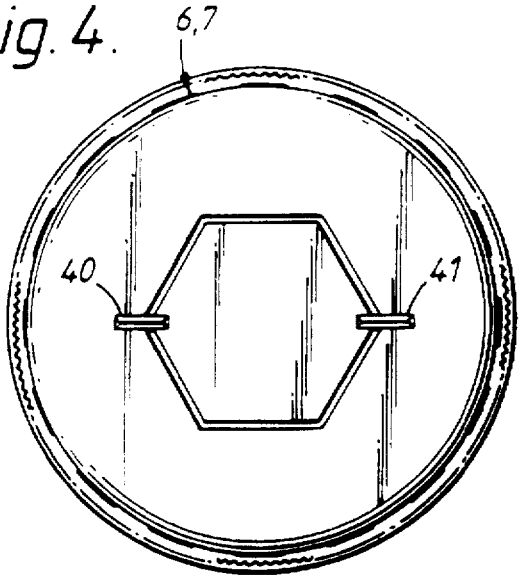

FIG. 4. is a plan view of the cap of FIG. 3.

Figure 5:
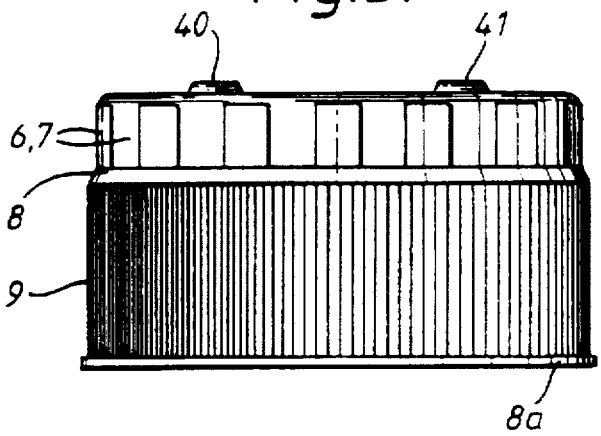

FIG. 5. is an unsectioned side view of the cap on FIG. 3. in its closing position.

Figure 6:
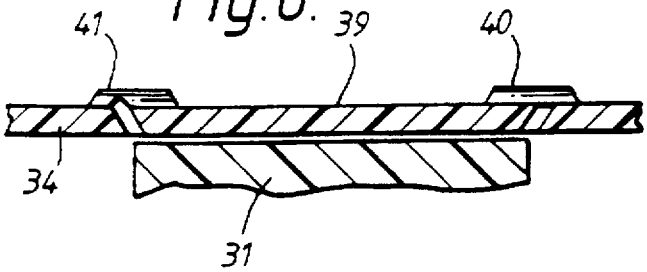

FIG. 6. is an enlarged sectioned side view of the top of the cap of FIG. 3, in its closing position.

Figure 7:
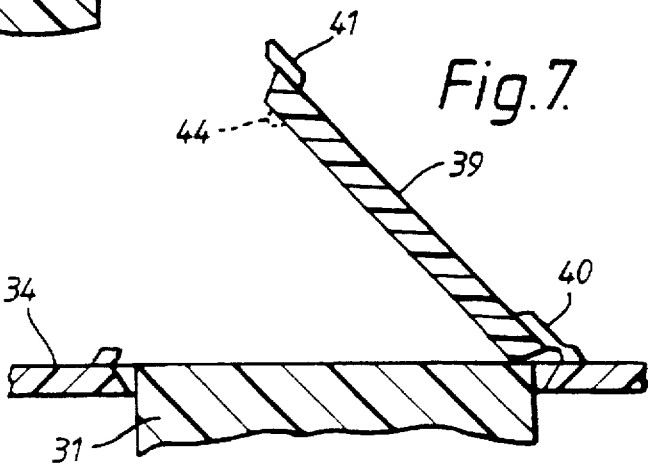

FIG. 7. is an enlarged sectioned side view of the top of the cap of FIG. 3, in its opening position, with an optional stud shown as dotted.

Figure 8:
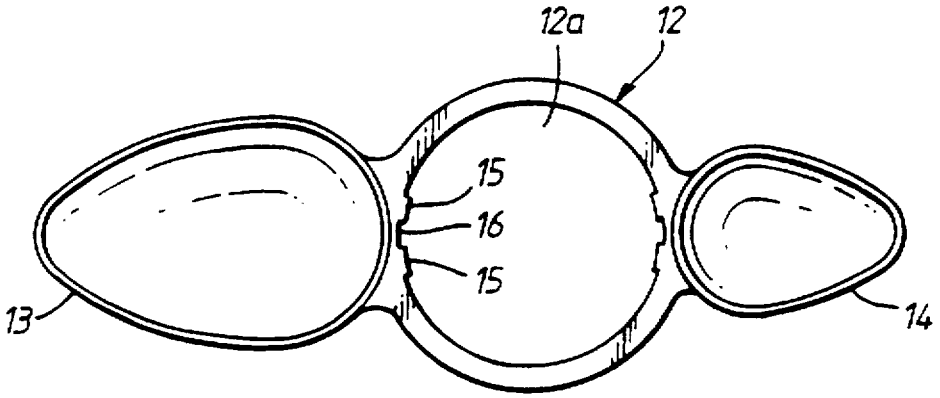

FIG. 8. is a plan view of a double dosing spoon.

Figure 9:
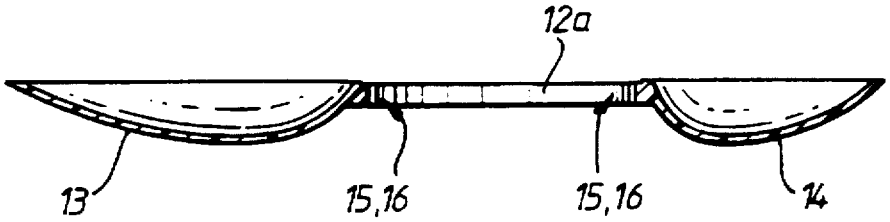

FIG. 9. is a side view of the spoon of FIG. 8.

Figure 10:
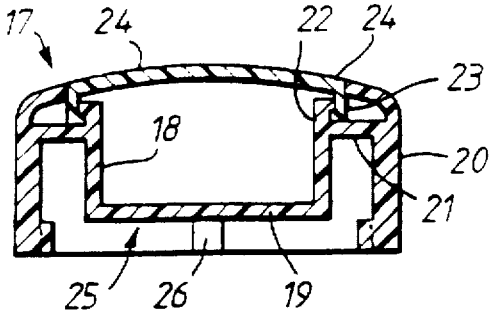

FIG. 10. is sectioned side view of a tablet storage box.

Figure 11:
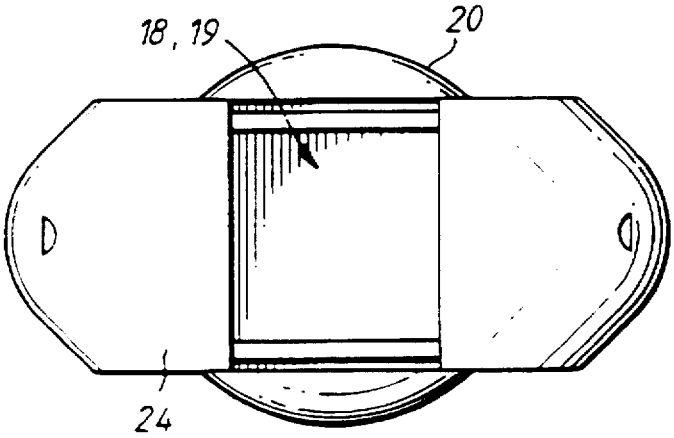
Figure 12:
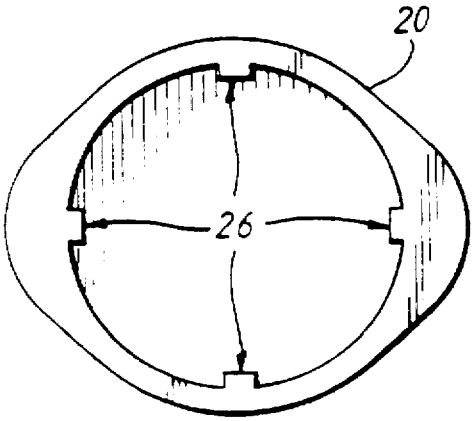

FIG. 11. is a plan view of the storage box of FIG. 10. with its lid open; and FIG. 12. is a view of the storage box of FIG. 10. from underneath.

Figure 13:
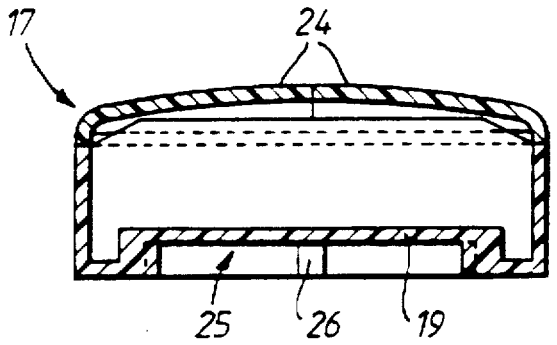
Figure 14:
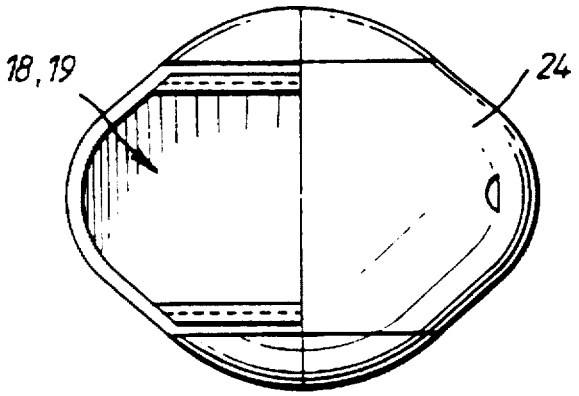

FIG. 13 and 14. show a sectional side view and plan view of another tablet storage box.

Referring to FIGS. 1 and 2, a one piece unitary circular shaped cap 1 for a pharmaceutical container (not shown) is formed by injection moulding with a plastics suitably polypropylene, and comprises a top 2 and a depending annular skirt 3, which in this case is circular. As normal, the neck of the container is receivable at the lower end of the skirt 3 to mate with a screw thread 4 on the inner surface thereof. A linear circular wad 5 is provided at the top end of the screw thread 4.

In order to open the cap if it becomes jammed, a first engaging means 6, 7 is provided in the form of a plurality of co-axial, mutually spaced ribs 6 and flutes 7 around the outer and upper end portion of the skirt 3. At the base of the ribs 6 and flutes 7 is formed on upper continuous shoulder 8 extending around the circumference of the skirt for an annular spanner to abut against. A lower continuous shoulder **8*a* extends around the bottom outer edge of the skirt 3, and a finer ribbed pattern 9 allowing a twist grip is provided between the upper 8 and lower 8*a* shoulders. A standard frangible tamper evident ring 10 depends from the bottom edge of the skirt 3**.

Referring to FIGS. 7 and 8, a unitary double dosing injection moulded plastics spoon, suitably made of polypropylene comprises an annular spanner 12 (defining an spanner aperture 12*a*), which in this instance is circular and continuous, and a 5 ml and 2.5 ml spoon 13 and 14 extending diametrically outwardly from the spanner 12. Two spaced lugs 15 are provided adjacent each spoon extending radially inwardly from the inner surface of the spanner, and define a niche 16 therebetween. The lugs 15 and niches 16 (which are narrower than the ribs 6 and flutes 7 of the cap), form a second engaging means. In operation, the annular spanner is pushed down over and around the top 2 of the cap 1 to abut the upper shoulder 8 thereof. In this position each lug 15 meshes in a corresponding flute 7 between two ribs 6, and substantially diametrically opposed ribs 6 are similarly engaged in the niches 16 between the corresponding pairs of lugs 15. This illustrates how general projection and corresponding recesses can form engaging means in accordance with the invention. On now gripping the spoons 13 and 14 (as a handle) and twisting the spanner 12 anticlockwise, the jammed cap 1 can be opened and removed.

A further medical implement embodying an annular spanner in accordance with the invention is shown in FIGS. 10 to 12. Here a tablet storage box 17 is formed of an inner basin 18, 19 having an inner annular wall 18 and base 19, an outer annular wall 20 connected at its top edge by a web 21 to the upper portion of the inner wall 18, and having an outturned lip 22 for engaging a corresponding lip 23 depending from the lower surface of the two sliding leaves 24 (which form the lid of the storage box 17). The leaves 24 are shown in their open position in FIG. 11. As shown in FIG. 10, the lower portion of the outer annular wall 20 extends below the base 19 of the inner basin 18, 19 and form the annular spanner 25 of the dual purpose storage box. Four lugs 26 (again narrower than the ribs 6 of the cap) extend radially inwardly from approximately the 12, 3, 6, and 9 o'clock positions of the lower outer annular wall 20 to form the second engaging means for cooperably engaging between the adjacent ribs 6 on the cap 1.

As is illustrated by the ovular outer wall 20 of the storage box, reference herein to annular should not be narrowly construed, and may also include for example a hexagonal shape. The ovular shape of the storage box provides sufficient twist grip for unjamming the cap 1, or optionally the leaves 24 could be opened (as shown in FIG. 11) to provide an additional handle.

Referring now to FIGS. 3 to 5, there is shown a two piece cap embodying the first engaging means as illustrated in FIGS. 1 and 2 which is one aspect of the invention, and also embodying a tamper evident hinged tab as another aspect of the invention. This two piece cap is of the general child resistant type which requires to be simultaneously depressed and twisted for removal.

As shown in FIG. 3, the cap comprises a hollow inner piece 26 receivable within an outer shell, piece 27. The inner piece 26 comprises a planar circular top 28 with a depending skirt 29, inner screw thread 30, a tamper evident hexagonal boss 31 extending centrally from the top 20 of the inner piece 26 and a plurality of equally spaced studs 32 arranged therearound adjacent respective corners of the hexagonal boss 31. A linear wad 33 is located against the inner surface of the top 28.

The outer piece 27 also comprises a planar circular top 34 with a depending circular skirt 35. The top of the outer piece 34 is provided with a central cooperable hexagonal aperture 36, and six resiliant plastic tongues 37 depending at an angle from the inner surface of the top 34 of the outer piece and serially arranged adjacent each side of the hexagonal aperture 36. A tooth 38 having a gently inclined rear slip surface 38*a* extends downwardly from the root of each resilient tongue 37. A hexagonal tamper evident tab 39 is formed over the hexagonal aperture 36 and held by a hinge piece 40 and an opposed frangible (notched) connecting piece 41 (FIG. 6), being notched to weaken it. An upper and lower continuous shoulder 42 and 43 is provided as for the cap of FIGS. 1 and 2.

In the cap closing position (shown on the right hand side of FIG. 3) the tongues 37 urge the top of the inner piece 28 from the top of the outer piece 34 but engage with the studs 32 for clockwise closing of the cap. Anticlockwise rotation in this position results in the studs 32 riding over the tongues 37 in a 'clicking' fashion.

To unlock or open the cap, the annular spanner 12, 25 is pushed over and around the cap to engage the ribs 6 and flutes 7 and then urged against the upper continuous shoulder 42 to depress the outer cap piece 27 against the hexagonal boss 31 of the inner cap piece 26 and thus break the frangible connecting piece 41 to hinge open the tamper evident tab 39 against hinge piece 40 and reveal the hexagonal boss. In this embodiment the hexagonal boss 31 (which is deeper than the boss shown in GB 2167050) acts not only as a tamper evident means but also locks with the hexagonal hole 36 to help in opening the cap. The teeth 38 also engage behind the adjacent studs 32 on depression of the outer piece to form a further unlocking or drive mechanism. If however this mechanism becomes gummed up by the medicine, the spanner 12, 25 can still be used to open the cap. It will be appreciated that in the absence of the upper continuous shoulder, the lower shoulder can act as the seating means for the annular spanner.

It will also be appreciated that by having a weaker frangible connecting piece 41, the tamper evident tab is not catapulted off, as it is with the cap of GB 2142612, but rather hinges back. Another way of achieving this hinging action is to have connecting pieces of the same strength, but with a contact stud 44 (shown as optional and dotted in FIG. 7.) on the underside of the tamper evident tab adjacent one of the connecting pieces so that the stud is first to contact the hexagonal boss and the resultant pressure breaks said adjacent connecting piece, i.e. it is the breakable connecting piece.

FIGS. 13 and 14 show another tablet storage box in accordance with the invention which is slightly different from that shown in FIGS. 10 to 12, but retains where possible the same reference numbers.

I claim:

1. A kit for removing a cap on a medical container comprising, in combination:

a two-piece child-resistant cap requiring simultaneous depression and twisting for removal from the container, said cap having a top, a depending skirt and an open lower end opposite said top for receiving a neck of the medical container, said skirt having along an outer, upper surface portion thereof a first engagement structure consisting of a plurality of ribs and flutes extending axially from adjacent the top of the cap and circumferentially extending about said upper surface portion of said skirt and a seat along said upper surface portion of said skirt adjacent a base of said ribs and flutes, and a discrete opening aid normally separate from and unconnected to said cap comprising an annular spanner for engagement over said cap and removable therefrom, said annular spanner having an interior surface carrying a second engagement structure including a pair of projections extending radially inwards and spaced from one another about said interior surface for engagement in a flute between adjacent ribs of the cap, said opening aid also comprising a twist grip handle to allow the annular spanner to abut against the seat of the cap by downward pressure over the cap, on the twist grip hand, thereby enabling the cap to be removed from the medical container upon depressing and rotating the annular spanner.

2. A kit according to claim 1 wherein said seat is a shoulder which extends continuously around said skirt.

3. A kit according to claim 1 wherein said opening aid is a double dosing spoon comprising a continuous circular annular spanner carrying spaced lugs defining the second engagement structure and two dosing spoons defining the grip twist handle extending diametrically outwards from the annular spanner.

4. A kit according to claim 1 wherein the opening aid is in the form of a tablet storage box comprising an outer annular wall, an inner basin for storage of the tablets having an inner annular wall and base, the lower portion of the outer annular wall extending below the base of the basin and carrying inwardly extending lugs to define the annular spanner, the outer wall of the storage box proving the twist grip handle.

5. A kit according to claim 4 wherein the storage box is ovular to provide an improved twist grip.

6. A kit according to claim 1 wherein said inner part of the cap has a top provided with an upwardly extending tamper-evident projection, and said outer part of the cap has a top with an aperture for receiving the tamper-evident projection, said aperture being normally closed by a tamper-evident tab connected to the outer part by a connecting piece, such that on depression of the outer cap, the tamper-evident projection will extend through said aperture fracturing the tamper-evident tab.

7. A kit for removing a cap on a medical container comprising a two-piece child resistant cap requiring simultaneous depression and twisting for removal from the container, said cap comprising an outer shell and a hollow inner piece receivable within the outer shell, biasing means located between the inner piece and outer shell biasing the inner piece and outer shell apart in an unlocked position, and engaging means located between the inner piece and outer shell which engage on depression of the outer shell to enable the cap to be removed by twisting relative to and from the medical container, said inner piece having a top, a depending skirt and an open lower end opposite said top for receiving a neck of the medical container, said outer shell having a top with a depending circular skirt having along an outer, upper surface portion thereof a first engagement structure consisting of a plurality of ribs and flutes extending axially from adjacent the top of the outer shell and circumferentially extending about said upper surface portion of the outer shell, and a seat extending along said upper surface portion of the outer shell adjacent a base of said ribs and flutes; and a discrete opening aid normally separate from and unconnected to said cap comprising an annular spanner for engagement over said cap and removable therefrom, said annular spanner having an interior surface carrying a second engagement structure including at least a pair of projections extending radially inwards and spaced from one another about said interior surface for engagement in a flute between two adjacent ribs of the cap, said opening aid also comprising a twist grip handle to allow the annular spanner to abut against the seat of the cap by downward pressure over the cap on the twist grip handle, thereby enabling the cap to be removed from the medical container upon depressing and rotating the annular spanner.

* * * * *